US011898815B2

(12) United States Patent
Wilkinson

(10) Patent No.: US 11,898,815 B2
(45) Date of Patent: Feb. 13, 2024

(54) SEMI-AUTOMATIC SHOTGUN

(71) Applicant: James Wilkinson, Laramie, WY (US)

(72) Inventor: James Wilkinson, Laramie, WY (US)

( * ) Notice: Subject to any disclaimer, the term of this patent is extended or adjusted under 35 U.S.C. 154(b) by 183 days.

(21) Appl. No.: 17/436,026

(22) PCT Filed: Oct. 1, 2019

(86) PCT No.: PCT/US2019/054140

§ 371 (c)(1),
(2) Date: Sep. 2, 2021

(87) PCT Pub. No.: WO2020/106367

PCT Pub. Date: May 28, 2020

(65) Prior Publication Data

US 2022/0170713 A1 Jun. 2, 2022

Related U.S. Application Data

(60) Provisional application No. 62/739,498, filed on Oct. 1, 2018.

(51) Int. Cl.

| | |
|---|---|
| ***F41A 5/24*** | (2006.01) |
| ***F41A 21/48*** | (2006.01) |
| ***F41A 9/70*** | (2006.01) |
| ***F41A 19/47*** | (2006.01) |

(52) U.S. Cl.
CPC ..... *F41A 21/48* (2013.01); *F41A 5/24* (2013.01); *F41A 9/70* (2013.01); *F41A 19/47* (2013.01)

(58) Field of Classification Search
CPC ..... F41A 5/24; F41A 5/28; F41A 3/26; F41A 5/26; F41A 5/18; F41A 11/02; F41A 15/14; F41A 3/16; F41A 3/38; F41A 21/48; F41A 9/70; F41A 19/47; F41A 3/66; F41A 15/16; F41C 7/02; F42B 7/02
USPC ..... 89/191.01, 193, 128, 185; 42/25, 72, 42/75.01–75.1
See application file for complete search history.

(56) References Cited

U.S. PATENT DOCUMENTS

| | | | |
|---|---|---|---|
| 2,336,146 | A | 12/1943 | Williams |
| 2,941,450 | A | 6/1960 | Crittendon et al. |
| 2,951,424 | A | 9/1960 | Stoner |

(Continued)

OTHER PUBLICATIONS

Supplementary European Search Report EP19886182.

*Primary Examiner* — Michael D David
(74) *Attorney, Agent, or Firm* — Optima Law Group, APC; Thomas E. Jurgensen

(57) ABSTRACT

A semiautomatic shotgun successfully uses the AR-10 receiver and the superior direct impingement gas system. A combination of locking lugs to maintain proper sequencing, a spring disposed inside of a gas impingement chamber, and a spring to cycle the action. Fouling is avoided using nickel-boron coated parts, permanent infusion of a dry film lubricant, and an angled gas port. A unique magazine feed lip and barrel extension feed ramp and the magazine maintaining the shells at a slight angle upward, and a bolt face having a rear facing partial bevel avoid jamming and snagging. The present invention also teaches raised gas tube and gas key to accommodate the larger bore of the shotgun. The combination achieves an AR-10 based shotgun which has the advantages of direct impingement cycling (less recoil, greater accuracy, etc) without fouling and/or jamming.

12 Claims, 25 Drawing Sheets

(56) References Cited

U.S. PATENT DOCUMENTS

| | | | | |
|---|---|---|---|---|
| 3,329,064 | A | 7/1967 | Segrest | |
| 4,867,039 | A | 9/1989 | Dobbins | |
| 5,272,956 | A | 12/1993 | Hudson | |
| 7,891,284 | B1 * | 2/2011 | Barrett | F41A 5/28 89/193 |
| 8,201,489 | B2 | 6/2012 | Juarez | |
| 8,210,089 | B2 | 7/2012 | Brown | |
| 9,046,312 | B2 | 6/2015 | Dieckmann | |
| 9,328,981 | B2 | 5/2016 | Kenney | |
| 9,347,737 | B2 | 5/2016 | Troy et al. | |
| 2012/0066950 | A1 * | 3/2012 | Davidson | F41A 9/69 42/50 |
| 2015/0135942 | A1 | 5/2015 | Gomez | |
| 2015/0330730 | A1 * | 11/2015 | Stone | F41C 23/18 89/33.01 |
| 2016/0178302 | A1 | 6/2016 | Daniel et al. | |
| 2016/0178308 | A1 | 6/2016 | Daniel et al. | |
| 2016/0298918 | A1 | 10/2016 | Baker et al. | |
| 2016/0327353 | A1 * | 11/2016 | DiChario | F41A 9/70 |
| 2016/0327354 | A1 | 11/2016 | Dichario | |
| 2018/0142981 | A1 | 5/2018 | Collazo et al. | |
| 2018/0156553 | A1 | 6/2018 | Rode et al. | |
| 2018/0156590 | A1 * | 6/2018 | Reuther | F42B 12/382 |
| 2018/0259279 | A1 | 9/2018 | Khoury et al. | |
| 2021/0231396 | A1 * | 7/2021 | Brown | F41A 9/70 |
| 2021/0254913 | A1 * | 8/2021 | Parker | F41A 9/58 |

* cited by examiner

SEMI-AUTOMATIC SHOTGUN

CROSS-REFERENCE TO RELATED APPLICATIONS

This application claims the priority, benefit and filing date of previously filed and U.S. provisional patent application No. 62/739,498 filed Oct. 1, 2018 in the name of the same inventor James Wilkinson and having the title SEMI-AUTOMATIC SHOTGUN.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but reserves all copyright rights whatsoever. 37 CFR 1.71(d).

FIELD OF THE INVENTION

This invention relates generally to shotguns and specifically to semiautomatic shotguns based upon the AR-10 design.

STATEMENT REGARDING FEDERALLY FUNDED RESEARCH

This invention was not made under contract with an agency of the US Government, nor by any agency of the US Government.

BACKGROUND OF THE INVENTION

The AR-10 design platform rifle is one of the more widely known and used firearms of the 20$^{th}$ century. Light, compact, and easy to customize, the design showed immediate benefits compared to similar designs known in the 1950s. While the initial number of actual AR-10 units manufactured by A. I. was fairly small, the Colt company bought the design to alter (caliber reduction from 7.62 down to .223, moving the charge handle, etc), and won the US army competition to produce the M-16. Colt also sells the AR-15 civilian version as well, a semiautomatic rifle. After Armalite's initial round of patents expired, the adaptability of the design (the lower receiver being usable in a wide variety of ways) led to a very large number of further adaptations. Thus the AR-10 family has grown and the number of units and types has proliferated for decades.

However, one particular adaptation is quite difficult.

Shotgun shells pose a number of problems for the light and compact mechanisms of the AR-10 family. One initial issue is that the gas pressure which a shotgun shell develops in a chamber after firing is significantly lower than the pressure developed by a metal cartridge high velocity round like the 7.62×51 or the .223 (which obviously propel bullets, not shot). In addition the sheer size difference between gun components for a .3 or .223 (about ¼ or ⅓ inch bore diameter) versus a shotgun shell (¾ inch or more) require the "upper" receiver to be heavily modified.

In addition, a shotgun cartridge is rimmed, while a rifle cartridge is rimless. The small indent at the base of a metal rifle cartridge allows for a simple removal mechanism, usually just a catch which pops up into the indent and then pulls backward with the rimless rifle cartridge. However, there is no indent on a rimmed shotgun shell.

More significantly, feeding of shotgun shells from a single stack magazine (such as used at the front end of an AR-10 family receiver) can be surprisingly difficult. The AR-10 and most of the many members of its family are based around use of a narrow, necked, pointed-tip round. The front end of the round functions as a multi-angle ramp to lift the round over components of the magazine, the barrel, chamber, and so on.

Shotgun shells of course are blunt ended and most gauges are much wider. The mechanics of feeding the shell and handling it during the cycle are substantially different than the issues of handling the original 7.62 mm round. The shell does not easily "ride up" over obstructions, tending to get jammed instead. In addition, the shell's blunt end presents a ridge or corner when the bolt face is moving backward after firing, and the bolt can damage the round or hypothetically even snag on it.

But beyond that, there is another even more significant problem, one which has as yet prevented commercial adoption of a direct impingement shotgun based on the AR-10. The third major problem is fouling. Fouling is a very serious problem for semiautomatic shotgun designs.

Stepping back, there are two major types of gas systems used on semiautomatic rifles. The direct impingement system is simpler and considered superior in certain ways, but the gas piston system is frequently used instead.

In the direct impingement system, gas from the barrel is directed back and into the action of the weapon, where it is used to actuate the recoil of the bolt carrier away from the bolt (effectively sliding the bolt carrier backwards), which eventually rotates the bolt for it to move, as well as the ejection of the metal cartridge and the return of the bolt, which strips the topmost round from the magazine and feeds it into the chamber. It is a balance of speed of unlocking the bolt lacking lugs versus pressure available for a successful cycle.

The gas piston system uses the expanding gases to drive a piston, which then mechanically drives the action.

Now the firing properties of the two systems are debated endlessly, however, it is generally conceded that the gas piston causes a slight jerkiness to the recoil: the direct impingement system is thus often considered to be more accurate during high speed semiautomatic fire, and the upper receiver parts tends to wear faster. The weight of the gas piston is also a factor.

On the hand, the gas piston system avoids allowing gas to foul the action of the rifle. The rifle may remain cooler and more reliable overall using the less elegant gas piston. These are important issues in high stress environments.

In the case of semiautomatic shotguns, the fouling situation is even worse. The shotgun shell contains wadding not found in a cartridge, the shot, wadding and plastic/paper case scrape against one another at the instant of firing and often pull parts off the soft case, wadding or shot, and the end result is a relatively "dirty" round.

Experimentation by the inventor has determined that a normal gas impingement system used for shot with an AR-10 family receiver normally may result in fouling and even jamming in as few as a handful of rounds. This makes use of direct impingement systems to be almost impossible.

The marketplace bears out the difficulty of solving all of these problems. There are in fact various AR-10/15/M-16/knock-off receiver based shotguns on the market.

They use gas piston systems.

The Raptor ATAC and KRX Tactical by Tristar are examples of this, in 12 gauge with 3" chambers, as is the Lynx LH-12, in which the sheer size of the gas piston system atop the barrel is very noticeable.

The EAA MKA-1919 may be the oldest attempt to make an AR family shotgun, but it ends up being a stylistic similarity.

RIA imports offers a similar system in 12 gauge×3".

The VR60 clearly shows its AR-15 pedigree, but like the RIA design does not actually offer a detachable receiver.

The UTAS XTR-12 can be converted from 12 gauge to .308 (7.62 mm) easily, but it also has a gas piston system. Century Arms Fury II 12×3" is another with a pronounced piston system atop the barrel, and the arrangement of Standard Manufacturing's SKO piston atop the barrel makes it look more like a Kalashnikov gas piston system than an AR based design. The JTS 12 just calls itself an "AK Shotgun".

The same can be said for the DDI Puma 12 LA-K12 (2¾ inch), which seems to be modeled on a Chinese Army design. The Remington 870DM is pump action anyway, as is the Mossberg 590M.

Other designs include the Legacy Sports Citadel RS-S1, the AA-12, the unusual Lone Star "Locksmith" entry device, the MOLOT Vepr 12 Tactical, and presumably more.

The inventor is not aware of any direct impingement system for AR family shotguns on the market.

In fact, just achieving a true AR family experience is so difficult that gunworld.com said, > "It's no secret that the "holy grail" of tactical shotguns is one that precisely matches the AR-15 in form and function, with identical appearance, controls, take-down, manual of arms and, most importantly, reliability. And, like the actual Holy Grail, such a shotgun has largely proven elusive to those in its quest."

Ironically, that statement was made in a review of the UTAS design mentioned above, which same review goes on to admit is a gas piston design!

It would be preferable to provide an ACTUAL direct impingement semiautomatic shotgun which defeats the known problems of fouling.

It would also be preferable to provide a semiautomatic shotgun which is more closely based upon the AR family of receivers, especially the AR-10, but also the AR-15, etc.

It would further be preferable to find solutions to the known problems of shotgun shell feeds from a straight magazine.

SUMMARY OF THE INVENTION

General Summary

The present invention teaches a semiautomatic shotgun built on the lower receiver of a member of the AR-10 family of rifles. Depending on how it is counted this generally includes the AR-15 and so on. These popular weapons are easily customized and altered. The present invention teaches that an AR-10 family member can be used as the foundation for a semiautomatic shotgun NOT using a gas cylinder, but instead using direct impingement.

The present invention teaches that with the proper bolt and bolt carrier elements, the problem of low gas pressure can be overcome. In particular, a combination of locking lugs to maintain proper sequencing, and a spring disposed inside of a gas expansion/impingement chamber, allow the gas to open the chamber and extract the spent shell case and the spring to cycle the action to chamber a fresh shell.

The problem of direct impingement gas systems fouling (especially in shotguns) is dealt with using a combination of nickel-boron coated metal parts (or nitrated parts), combined with permanent infusion of a dry film lubricant into the metal parts such as the upper receiver bore, and yet further by providing an angled (slanted) gas port.

The problem of blunt ended shotgun shells being difficult to chamber is also dealt with, by providing a unique magazine feed lip and barrel extension feed ramp. In addition, the magazine maintains the shells at a slight angle upward, and the bolt face has special accommodations—a rear facing partial bevel—to avoid snagging on the nose of the topmost shell as the bolt is moving backwards after firing.

The present invention also teaches raised gas tube and gas key to accommodate the larger bore of the shotgun.

It will be appreciated that it required years of design efforts and the combination of all of these seemingly diverse elements in order to achieve the goal of an AR-10 based shotgun which has the advantages of direct impingement cycling (less recoil, greater accuracy, etc) without the well known issues (fouling and/or jamming in a few rounds) normally associated with direct gas impingement.

Summary in Reference to Claims

It is therefore another aspect, advantage, objective and embodiment of the invention, in addition to those discussed previously, to provide a semiautomatic shotgun for use with first and second shotgun shells having a blunt front end, the semiautomatic shotgun comprising:

- a lower receiver from the AR-10 family of firearms;
- an upper receiver mounted to the lower receiver;
- a barrel dimensioned and configured to receive such shotgun shells into a chamber, the barrel having a distal muzzle end and a proximal end, the proximal end having thereon a barrel extension mounted to the upper receiver;
- a bolt slidably mounted and dimensioned and configured to slide in and out of the chamber across the open top end of the magazine in an upper receiver main bore;
- a bolt carrier mounted in an upper receiver bore so as to be slidable, the bolt extending into the bolt carrier;
- a direct impingement gas system in which gas from such first shotgun shell may cause extraction and ejection of such first shotgun shell and feed of such second shotgun shell;
- the direct impingement gas system including at least a gas port having upper and lower ends, the gas port passing through the barrel, the gas port having an angle to the barrel of greater than 90 degrees whereby the gas port lower end is slightly closer to the distal muzzle end while the gas port upper end is slightly closer to the proximal end;
- a low profile gas block mounted to the barrel at the gas port upper end;
- a gas tube elevated above the barrel, the gas tube connecting at a first end the gas port upper end and at a second end a gas key;
- the gas key having an aperture therethrough from the gas tube to a gas impingement chamber;
- the gas impingement chamber located within the bolt carrier, a first side of the gas impingement chamber being the bolt;
- the bolt slidably mounted within the bolt carrier such that the bolt may move relative to the bolt carrier, whereby the gas impingement chamber may change volume, and further whereby a pressure increase within the gas impingement chamber may cause the bolt and the bolt carrier to move relative to one another;

the bolt having a bolt tail projecting from the first side of the gas impingement chamber;

a spring mounted upon the bolt tail within the gas impingement chamber;

a cam pin passing through the bolt, the cam pin having a first end slidably mounted within an angled slot whereby when the bolt moves backward it is impelled to rotate due to the motion of the cam pin the angled slot;

a plurality of locking lugs on a front end of the bolt, the locking lugs dimensioned and configured to engage to the barrel extension when the bolt is in a first firing position, and configured to rotate and disengage from the barrel extension when the bolt rotates and moves backward into a second position;

whereby when the locking lugs disengage, a gas pressure in the chamber may cause rearward motion of the bolt carrier.

It is therefore another aspect, advantage, objective and embodiment of the invention, in addition to those discussed previously, to provide a semiautomatic shotgun further comprising:

a magazine mounted to the lower receiver, the magazine having an open top end;

the magazine having an angled feed lip, whereby when such first and second shotgun shells are pushed forward by the bolt sliding across the open top end of the magazine, such blunt front ends are elevated upward by such angled feed lip.

It is therefore another aspect, advantage, objective and embodiment of the invention, in addition to those discussed previously, to provide a semiautomatic shotgun wherein the barrel extension further comprises:

an angled feed ramp, whereby when such first and second shotgun shells are pushed forward and such shotgun shell blunt front ends are elevated upward by the angled feed lip, then such shotgun shell blunt front ends are elevated further upward by the angled feed ramp;

the angled feed ramp extending to the chamber, whereby such shotgun shell blunt front ends are fed from the magazine into the chamber.

It is therefore another aspect, advantage, objective and embodiment of the invention, in addition to those discussed previously, to provide a semiautomatic shotgun further wherein:

the magazine is dimensioned and configured to maintain such first and second shotgun shells at a slight angle to the horizontal, with such shotgun shell blunt front ends elevated upward to meet the angled feed lip of the magazine.

It is therefore another aspect, advantage, objective and embodiment of the invention, in addition to those discussed previously, to provide a semiautomatic shotgun, further comprising:

a bolt face dimensioned and configured to engage such first and second shotgun shells, the bolt face having a front, the bolt face front having an angled bevel, the angle of the bevel matching the angle of the barrel extension feed ramp, whereby the bolt face meets the barrel extension they seal.

It is therefore another aspect, advantage, objective and embodiment of the invention, in addition to those discussed previously, to provide a semiautomatic shotgun wherein the bolt face further comprises:

a back of the bolt face, the back of the bolt face having a partial bevel, whereby when the bolt moves backward it does not engage such second shotgun shell blunt front end.

It is therefore another aspect, advantage, objective and embodiment of the invention, in addition to those discussed previously, to provide a semiautomatic shotgun for use with a standard AR-10 family charge handle, wherein the gas key further comprises:

a coupling dimensioned and configured to engage such standard AR-10 family charge handle, whereby such standard AR-10 family charge handle does not bind to the cam pin, in turn whereby the charge handle may be used to manually retract the bolt carrier.

It is therefore another aspect, advantage, objective and embodiment of the invention, in addition to those discussed previously, to provide a semiautomatic shotgun wherein:

the barrel has a bore, the bore being greater than the bore of such standard AR-10 firearms;

the gas key further comprises an extension, thereby extending the gas key upward above the barrel.

It is therefore another aspect, advantage, objective and embodiment of the invention, in addition to those discussed previously, to provide a semiautomatic shotgun wherein:

the gas tube further comprises an extension, thereby extending the gas tube upward above the barrel.

It is therefore another aspect, advantage, objective and embodiment of the invention, in addition to those discussed previously, to provide a semiautomatic shotgun wherein a plurality of components are nickel-boron plated.

It is therefore another aspect, advantage, objective and embodiment of the invention, in addition to those discussed previously, to provide a semiautomatic shotgun wherein a plurality of components are nitrated.

It is therefore another aspect, advantage, objective and embodiment of the invention, in addition to those discussed previously, to provide a semiautomatic shotgun wherein a plurality of components are permanently infused with dry film lubricant.

It is therefore another aspect, advantage, objective and embodiment of the invention, in addition to those discussed previously, to provide a semiautomatic shotgun wherein a plurality of components are treated to improve lubrication without oil.

It is therefore another aspect, advantage, objective and embodiment of the invention, in addition to those discussed previously, to provide a semiautomatic shotgun wherein the upper receiver main bore is permanently infused with dry film lubricant and the bolt carrier is treated to improve lubrication without oil.

It is therefore yet another aspect, advantage, objective and embodiment of the invention, in addition to those discussed previously, to provide a semiautomatic shotgun wherein the bolt carrier further comprises:

a longitudinal slot, and further wherein the semiautomatic shotgun further comprises:

an ejector dimensioned and configured so that motion of the bolt carrier causes the slot to pass over the ejector, the ejector projecting out into the upper receiver bore and into the path of the first shotgun shell, whereby the first shotgun shell is given a torque, forcing the shell sideways.

It is therefore another aspect, advantage, objective and embodiment of the invention, in addition to those discussed previously, to provide a semiautomatic shotgun wherein the bolt further comprises at least two extractors, each extractor spring-loaded at a first end and having a slight detent at a second end, the detents oriented to physically engage such first shotgun shell, whereby when the bolt recoils, the extractors pull such first shotgun shell into the upper receiver bore until the ejector first disengages the first shotgun shell from a first one of the two extractors and then second gives the first shotgun shell the torque.

It is therefore another aspect, advantage, objective and embodiment of the invention, in addition to those discussed previously, to provide a semiautomatic shotgun for use with shotgun shells having a blunt front end, the semiautomatic shotgun comprising:

an upper and lower receiver;

a barrel dimensioned and configured to receive such shotgun shells into a chamber, the barrel having a distal muzzle end and a proximal end, the proximal end having thereon a barrel extension, the barrel extension in turn mounted to the upper receiver, the upper receiver in turn mounted to the lower receiver;

a magazine mounted to the lower receiver, the magazine having an open top end;

a bolt slidably mounted to the upper receiver and dimensioned and configured to slide in and out of the chamber across the open top end of the magazine;

the magazine having an angled feed lip, whereby when such shotgun shells are pushed forward by the bolt sliding across the open top end of the magazine, such shotgun shell blunt front end is elevated upward by such angled feed lip.

It is therefore another aspect, advantage, objective and embodiment of the invention, in addition to those discussed previously, to provide a semiautomatic shotgun wherein the barrel extension further comprises:

an angled feed ramp, whereby when such shotgun shells are pushed forward and such shotgun shell blunt front end is elevated upward by the angled feed lip, then such shotgun shells blunt front ends are elevated further upward by the angled feed ramp;

the angled feed ramp extending to the chamber, whereby such shotgun shells blunt front ends are fed from the magazine into the chamber.

It is therefore another aspect, advantage, objective and embodiment of the invention, in addition to those discussed previously, to provide a semiautomatic shotgun further wherein:

the magazine is dimensioned and configured to maintain such shotgun shells at a slight angle to the horizontal, with such shotgun shells blunt front ends elevated upward to meet the angled feed lip of the magazine.

BRIEF DESCRIPTION OF THE DRAWINGS

FIG. 12 is a cross-sectional side view of the top end of the magazine of the present invention showing details of the angle of the features of the magazine, the feed lip out of the magazine and so on.

FIG. 13 is an oblique view of the top end of the magazine of the semi-automatic shotgun of the present invention, with a shell properly secured therein, showing the angle of the shell, the angle of the feed lip and so on.

INDEX TO REFERENCE NUMERALS

Figure 1:
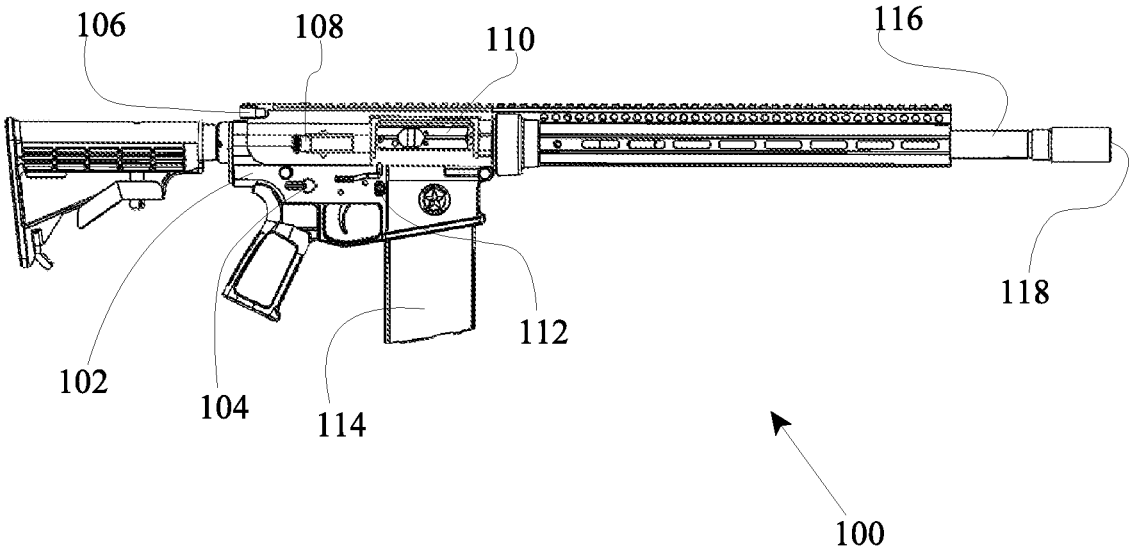
FIG. 1 is a side view of the AR-10 based semi-automatic shotgun of the present invention showing the external configuration.

Semiautomatic shotgun 100
Standard lower receiver AR-10 family 102
Safety 104
Charging handle 106
Forward assist 108
Ejection port 110
Magazine release 112
Magazine 114
Barrel 116
Muzzle 118
Barrel 204
Chamber 206
Distal muzzle end 208
Proximal end 210
Barrel extension 212
Direct impingement gas system 214
Upper receiver 215
Upper receiver bore 217
Gas port upper end 218
Gas port lower end 220
Gas port angle 222
Gas tube 224
Gas tube first end 226
Gas tube second end 228
Gas tube extension for elevation over larger bore 230
Gas key 232
Gas key aperture 234
Gas key extension for elevation over larger bore 236
Gas key coupling to charging handle 237
Gas impingement chamber 238
First side of gas impingement chamber (bolt back face) 240
Bolt 242
Ejector clearance slot 244
Bolt face angled bevel (front) 246
Bolt face partial bevel (back) 248
Bolt carrier 250
Bolt tail 252
Spring
Cam pin 256
Cam pin passage 257
Slot 258
Locking lugs 260
Magazine 262
Magazine ears 263
Magazine shell angle 264
Magazine feed lip 266
Barrel extension feed ramp 268
Extractor 270
Extractor 272
Firing pin 274
Extractor springs 276*a*, 276*b*
Extractor pins 278*a*, 278*b*
Gas rings 280
Fasteners 282*a*, 282*b*, 282*c*
Ejector 284

DETAILED DESCRIPTION

Glossary

As used herein, a "standard" AR-10 receiver (or "lower" receiver) is any of the family of receivers based upon the original 7.62×51 mm rifle designed by Armalite, including but not limited to the AR-15, M-16, various knock-offs, clones and licensed copies now know or later devised. Under current law in some jurisdictions the receiver is legally the firearm. This particular receiver family is extremely popular for its low weight, easy of use, widespread knowledge base and reliability.

As used herein, the "chamber" refers to the space at the proximal end of the barrel in which a shell sits when being fired. On the other hand, the "gas expansion chamber", "gas impingement chamber" or other references to a gas-related chamber refer to the expandable space behind the bolt and within the bolt carrier into which gas directly impinges, causing relative motion of the bolt carrier versus the bolt.

End Glossary

BRIEF DESCRIPTION OF THE DRAWINGS

FIG. 1 is a side view of the AR-10 based semi-automatic shotgun of the present invention showing the external configuration. It will immediately be noted that this configuration is extremely similar to the AR-10 family of firearms, for example the low profile of the upper surface, and thus is much more similar in actual mechanical detail than other semiautomatic shotguns, which may be styled to look like they belong to the AR family but in fact are based on gas piston technology, unlike the present invention.

Semiautomatic shotgun 100 has a largely standard lower receiver 102 from the AR-10 family, including familiar placement of such items as safety 104, charging handle 106, forward assist 108, ejection port 110, magazine release 112 and so on.

It will be appreciated that the controls shown are ambidextrous, with the exception of the forward assist 108 and obviously, the ejection port 110.

Magazine 114 is also found in the normal position. Barrel 116 and muzzle 118 may be seen.

It will be understood that while the basic invention is based upon the AR-10 family, in fact various aspects of the invention covered by the claims below may be employed with many types of shotguns, including gas piston types, pump-action and so on. Although the presently preferred embodiment and best mode now contemplated is chambered for a 12 gauge by 2¾ inch shotgun shell, 20 gauge, 410, etc may also be used within the scope of the claimed invention.

Figure 2:
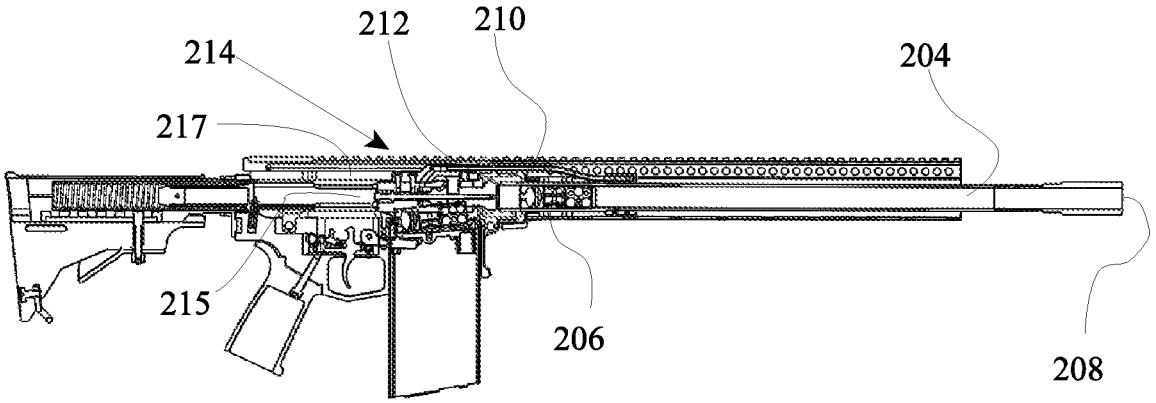
FIG. 2 is a cross-sectional side view of the AR-10 based semi-automatic shotgun of the present invention showing the overall internal configuration with a shell at the top of the unique magazine and unique feed ramp and a shell chambered.

FIG. 2 is a cross-sectional side view of the AR-10 based semi-automatic shotgun of the present invention showing the overall internal configuration with a shell at the top of the unique magazine and unique feed ramp and a shell chambered. Upper receiver 215 is attached to the lower receiver 102, with the barrel extension attached to the upper receiver.

Figure 3:
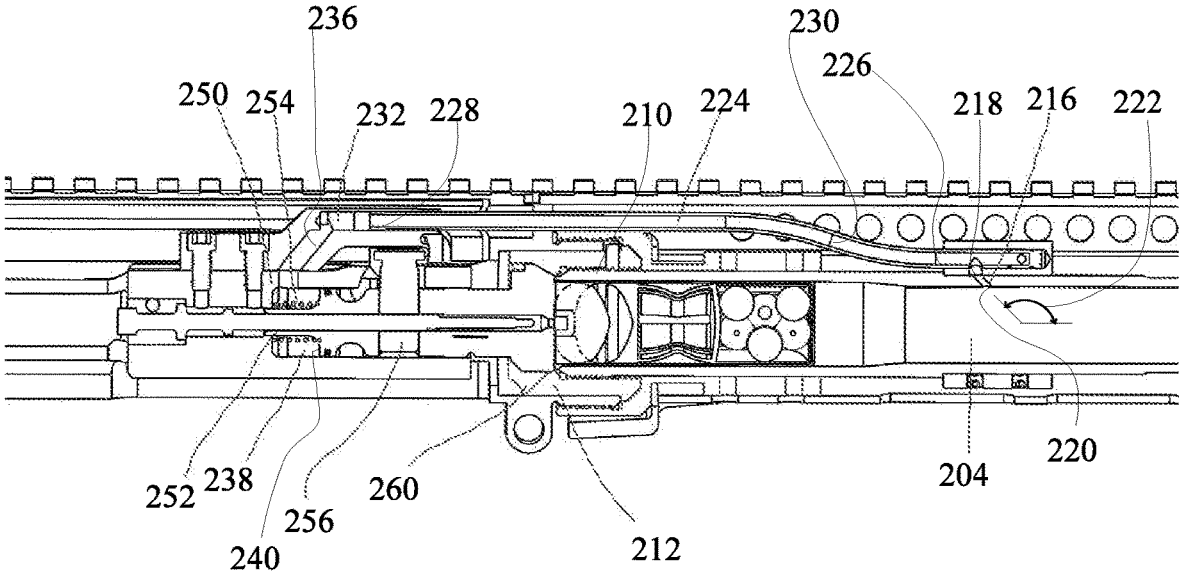
FIG. 3 is a cross-sectional side view of the AR-10 based semi-automatic shotgun of the present invention showing the detailed internal configuration in relation to the improved direct impingement gas system of the gun.

Barrel 204 has chamber 206. Distal muzzle end 208 and proximal end 210 may be equipped with various devices, in particular the proximal end 210 may have barrel extension 212. The barrel extension in turn may have a sloped ramp, called a feed ramp, to aid in the feeding of shells into the chamber 206. FIG. 3 is a cross-sectional side view of the AR-10 based semi-automatic shotgun of the present invention showing the detailed internal configuration in relation to the improved direct impingement gas system of the gun.

Testing by the inventor revealed that in as few as 7 shots a shotgun gas tube, gas port, gas key and impingement chamber could become fouled to the point of failure so that a direct impingement system would not work and the gas port 216 had to be drilled in order to be cleaned. This one fact may by itself be the reason that there seem to be no direct impingement semiautomatic shotguns on the market.

The present invention teaches a complete direct impingement gas system 214 which solves this problem and others as well. Gas port 216 is drilled through barrel 204, with a low profile gas block (not numbered) seen above the port: any type of gas block may be used. Gas port upper end 218 and gas port lower end 220 are offset at an angle from one another, gas port angle 222. This angle assists in keeping the system functioning and clean.

Gas tube 224 has a gas tube first end 226 which meets the block/port and a gas tube second end 228 which meets the gas key 232. However, the bolt, bolt carrier and general mechanism of a 12 gauge shotgun, and many shotgun gauges, is larger than the same components for a .308 or .223 rifle. Thus the mechanism is slightly higher and so a gas tube extension 230 for elevation over the larger bore is necessary.

Gas key 232 has a gas key aperture 234 (better seen by briefly adverting to FIG. 4) and then a matching gas key extension 236 for elevation over the larger bore as gas under pressure is transmitted back down behind the bolt 242 and into gas impingement chamber 238.

The front side 240 of the gas impingement chamber (the bolt back face) is thus operative to push bolt 242 toward the muzzle under pressure, but the remainder of the gas impingement chamber 238 is the bolt carrier 250 and thus is urged backward under pressure.

The bolt face has an angled bevel 246 on the front, which matches to the feed ramp discussed later, and also serves to help the bolt face ride over the front tip of a second shell as it is moving forward to chamber a first shell.

The bolt face also has partial bevel 248 on the back, which is very important in helping the bolt face ride over the front tip of the second shell after firing the first shell, when the bolt 242 is moving backward.

The bolt carrier 250 is furthermore treated as another necessary component of the present invention, once again, the goal is to avoid fouling. The metal of the internal components, in particular the upper receiver bore (in which the bolt carrier slides) are nickel-boron plated or nitrated, and then are permanently infused with a dry film lubricant. This is based upon years of testing by the inventor which showed that one major contributing factor to fouling was the normal oil-based lubricants, or other liquid-based lubricants, which tend to be just sticky enough to retain the dirty residues of firing.

Bolt tail 252 projects from the rear wall 240 of the bolt 242, and carries thereon spring 254. Spring 254 is yet another necessary part of the action of the invention. While shotgun shells are in general too low pressure to provide a complete action cycle reliably, the spring 254 actually assists the forward motion of the bolt 242 as it strips a shell out of the magazine and chambers it.

Figure 25:
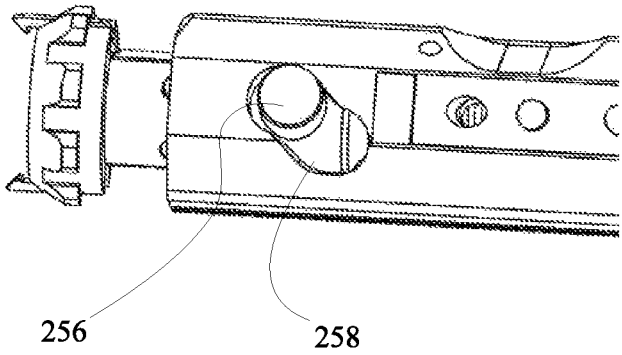
FIG. 25 is an orthogonal view of the bolt carrier showing the angled slot in which the cam pin travels.

Cam pin 256 sits in cam pin passage 257 (FIG. 7) and furthermore the head sits in slot 258 (see FIG. 25). In operation, the cam pin 256 forces the bolt 242 to rotate during recoil which in turn allows locking lugs 260 (best seen on FIG. 8) to rotate and when clear, to allow the bolt 242 to move backward. This is a balance of speed of unlocking the bolt and pressure: this balance must be maintained for a successful cycle and is in fact one of the crucial reasons prior art shotguns have used gas piston designs.

At this point it is important to mention sequencing. In particular, the gas system must move the bolt carrier 250 backward before bolt 242, and then the bolt 242 rotates, unlocks, moves backward, extracts and ejects the shell, and simultaneously compresses spring 254. The return stroke forward is aided by the compressed gas in the gas expansion chamber 238 and spring 254 both, which can overcome the pressure generated by the shell in the chamber 206/ejection port 110 region when the shell clears the ejection port 110 and the pressure in front of the bolt 242 falls dramatically.

Firing pin 274 may be seen passing through the bolt carrier, bolt, bolt tail and so on.

Figure 4:
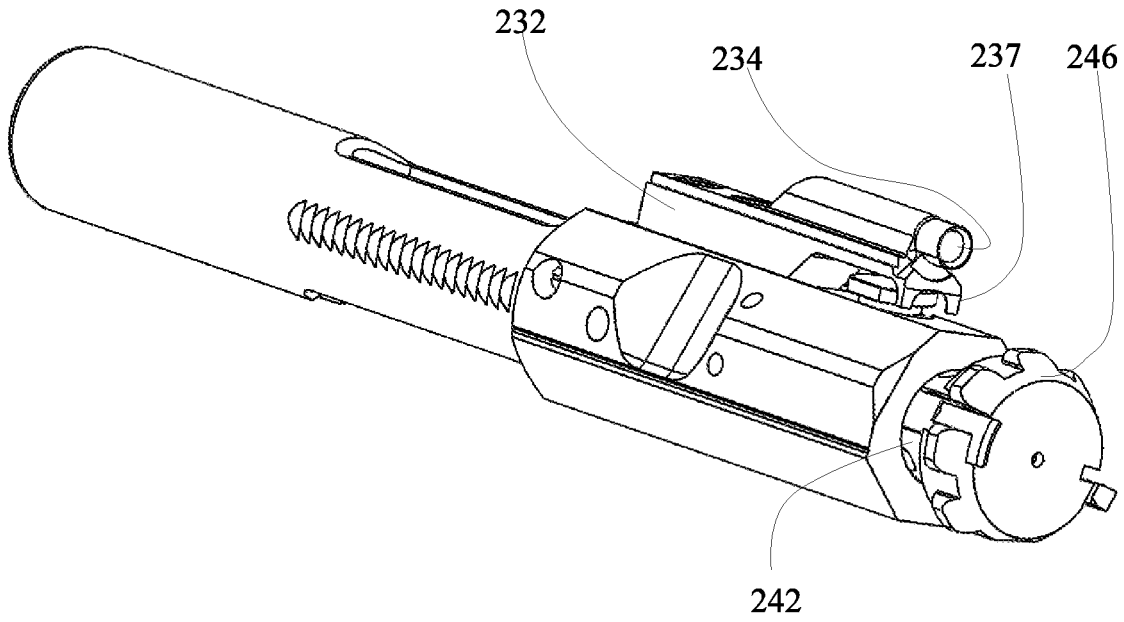
FIG. 4 is an elevational oblique perspective view of the bolt carrier of the action of the semi-automatic shotgun of the present invention, showing overall details of the bolt carrier.

FIG. 4 is an elevational oblique perspective view of the bolt carrier of the action of the semi-automatic shotgun of the present invention, showing overall details of the bolt carrier.

One feature of note is the gas key coupling to the charging handle 237: it will be remembered that the charging handle 237 may be useful in the shotgun embodiment, but must move due to the change in size from rifle to shotgun.

The front bevel 246 and the rear bevel 248 may be seen clearly, note that the rear bevel 248 is a partial bevel extending only around the lower periphery of the bolt 242 face. Gas key 232 and its passage 234 may be seen as well.

Figure 5:
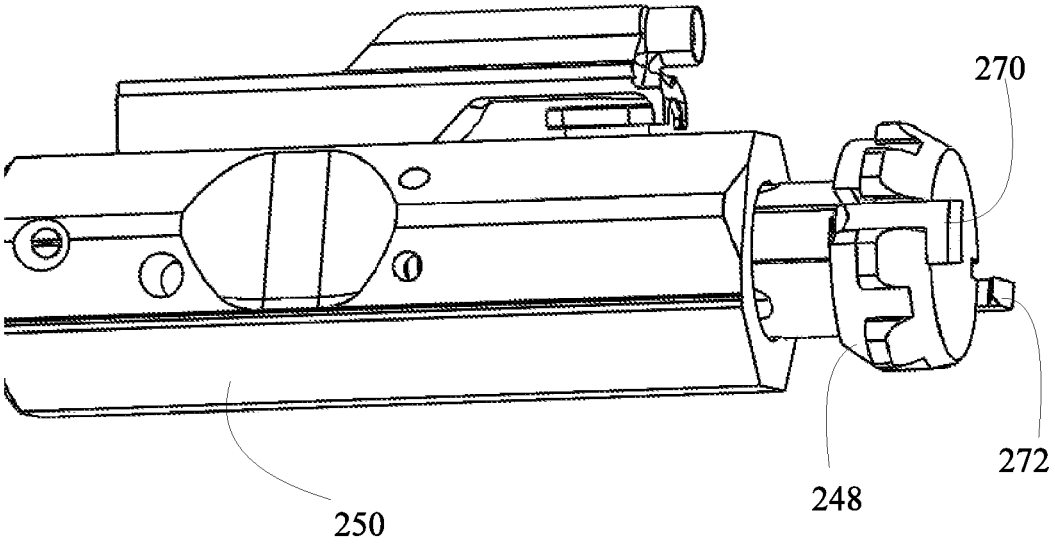
FIG. 5 is a slightly closer side/oblique perspective view of the bolt carrier of the semi-automatic shotgun of the present invention, showing in more specificity details of the bolt and carrier.

FIG. 5 is a slightly closer side/oblique perspective view of the bolt carrier of the semi-automatic shotgun of the present invention, showing in more specificity details of the bolt and carrier.

Extractor 270 and extractor 272 serve to pull the spent shotgun shell from the chamber 206 after firing, pulling on the metal rim (a ring shape) of the shell when the bolt 242 (not the bolt carrier 250) finally unlocks and moves backward.

Figure 6:
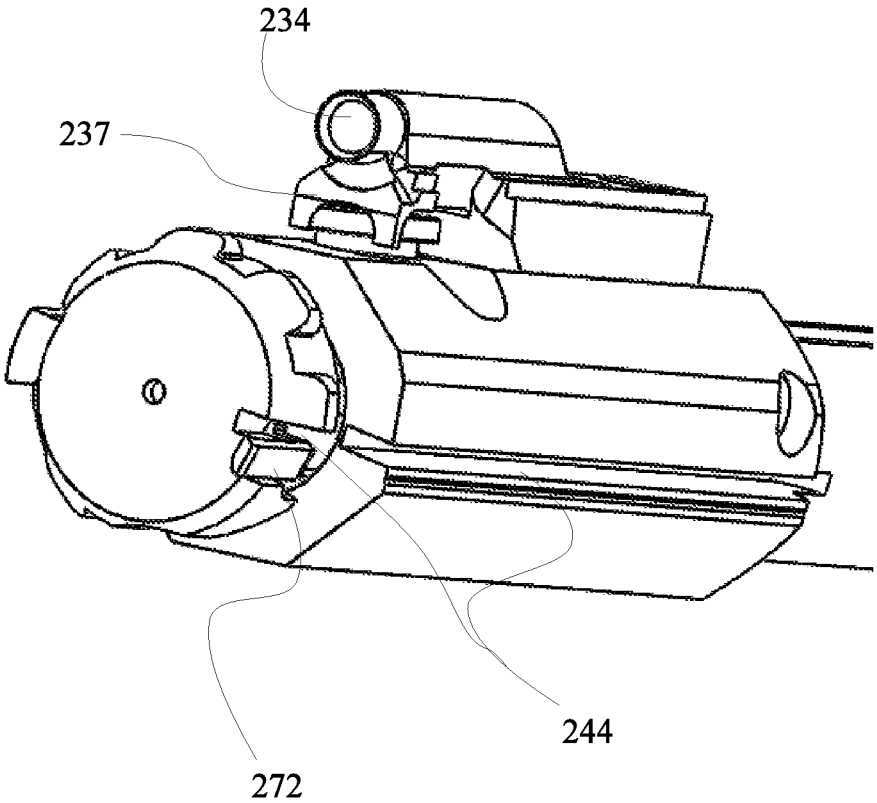
FIG. 6 is a reverse angle oblique perspective view of the BCG of the semi-automatic shotgun of the present invention.

FIG. 6 is a reverse angle oblique perspective view of the BCG of the semi-automatic shotgun of the present invention, showing the slot down the side allowing ejector clearance. Slot 244 is necessary so that the ejector 284 (briefly peruse FIG. 23) does not impede the motion of the bolt carrier 250 and bolt 242. Note that this slot extends across both the bolt carrier 250 and the bolt face 242, just above extractor 272 in this view. Thus extractor 272 helps to pull the shell out of the chamber 206, dragging it backward until the ejector 284 is encountered (the bolt and bolt carrier having passed across the ejector 284 unimpeded because of the presence of slot 244, and the shell then hits the ejector 284 which gives it an eccentric (off-center) push out and away through the ejector port 110.

The charge handle coupler 237 is also better visible in this view: the charge handle may be seen by briefly reverting back to FIG. 1.

Figure 7:
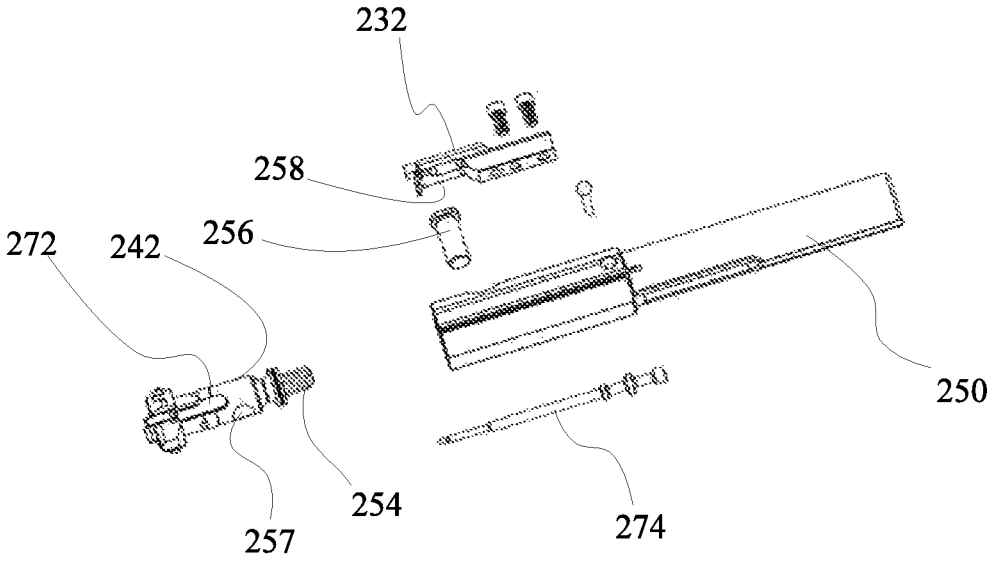
FIG. 7 is an elevational side perspective exploded view of the BCG of the shotgun of the present invention, showing important components thereof, including the spring mounted on the bolt tail.
Figure 8:
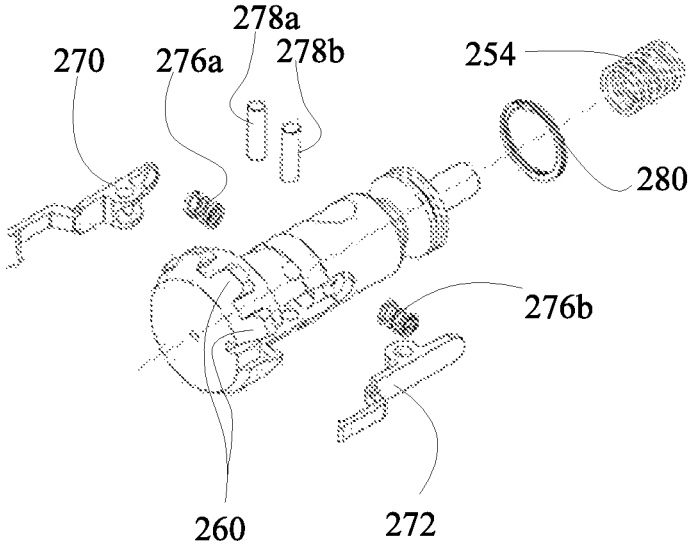
FIG. 8 is an end elevational oblique perspective exploded view of the bolt head of the present invention, showing details of the extractors, springs, and the bolt head itself.

FIG. 7 is an elevational side perspective exploded view of the BCG of the shotgun of the present invention, showing important components thereof, including the spring mounted on the bolt tail, and FIG. 8 is an end elevational oblique perspective exploded view of the bolt head of the present invention, showing details of the extractors, springs, and the bolt head itself.

Extractor springs 276*a*, 276*b* motivate the extractors 270, 272 to clamp onto the rim of the shotgun shell in the chamber but allowing the extractor 272 to release when the ejector 284 is encountered. Extractor pins 278*a*, 278*b* are the pivots or fulcrums for this spring action.

Gas rings 280 and fasteners 282*a*, 282*b*, 282*c* may be seen.

Figure 9:
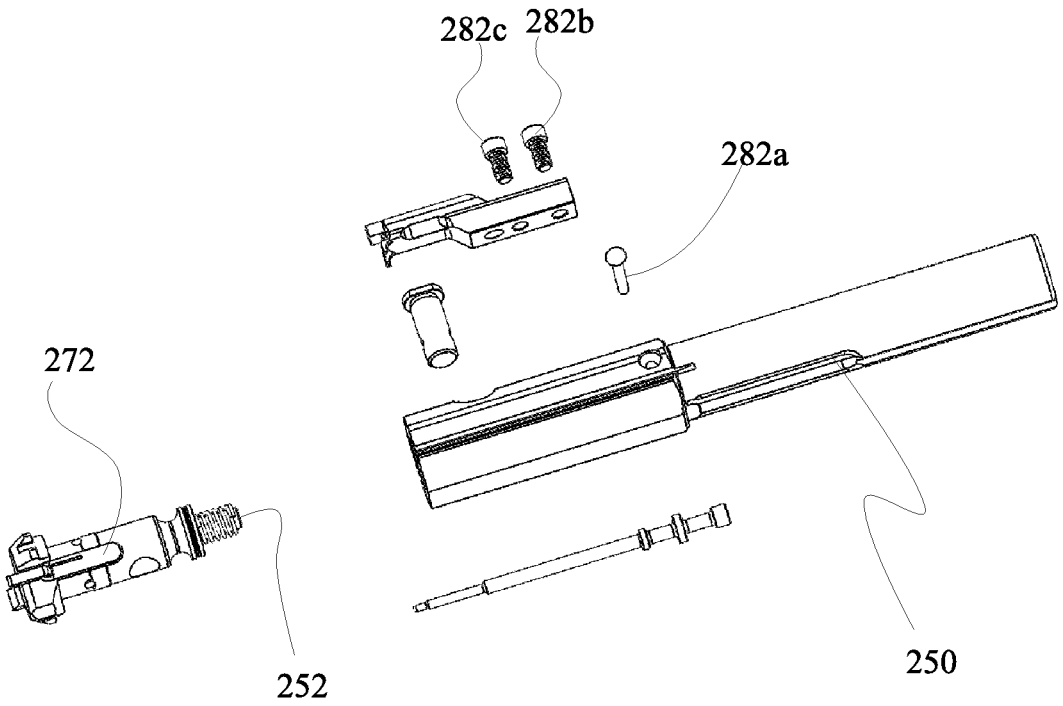
FIG. 9 is an elevational side perspective exploded view of the BCG of the shotgun of the present invention, showing important components thereof, including the spring mounted on the bolt tail.

FIG. 9 is an elevational side perspective exploded view of the BCG 250 of the shotgun of the present invention, showing important components thereof, including the spring mounted on the bolt tail 252, the fasteners 282*a*, 282*b* (bolts/set screws) and their cousin 282*c*, a pin.

Figure 10:
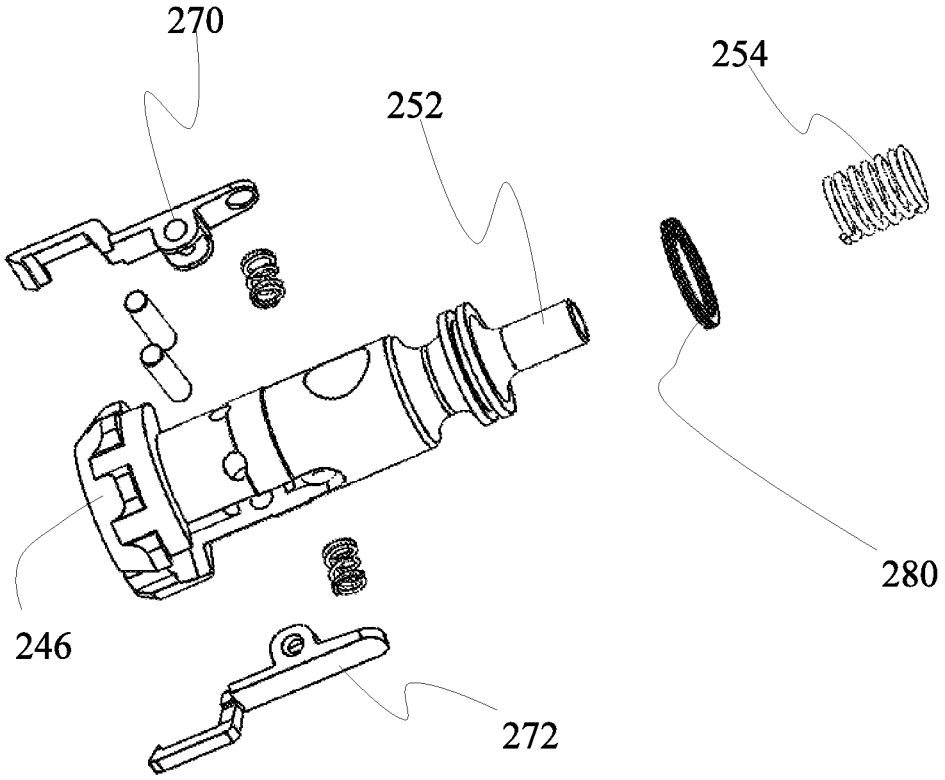
FIG. 10 is a side elevational oblique perspective exploded view of the bolt head of the present invention, showing details of the extractors, springs, and the bolt head itself.

FIG. 10 is a side elevational oblique perspective exploded view of the bolt head of the present invention, showing details of the extractors, springs, and the bolt head itself, better showing the shape of the bolt face/head, and the rings.

Figure 11:
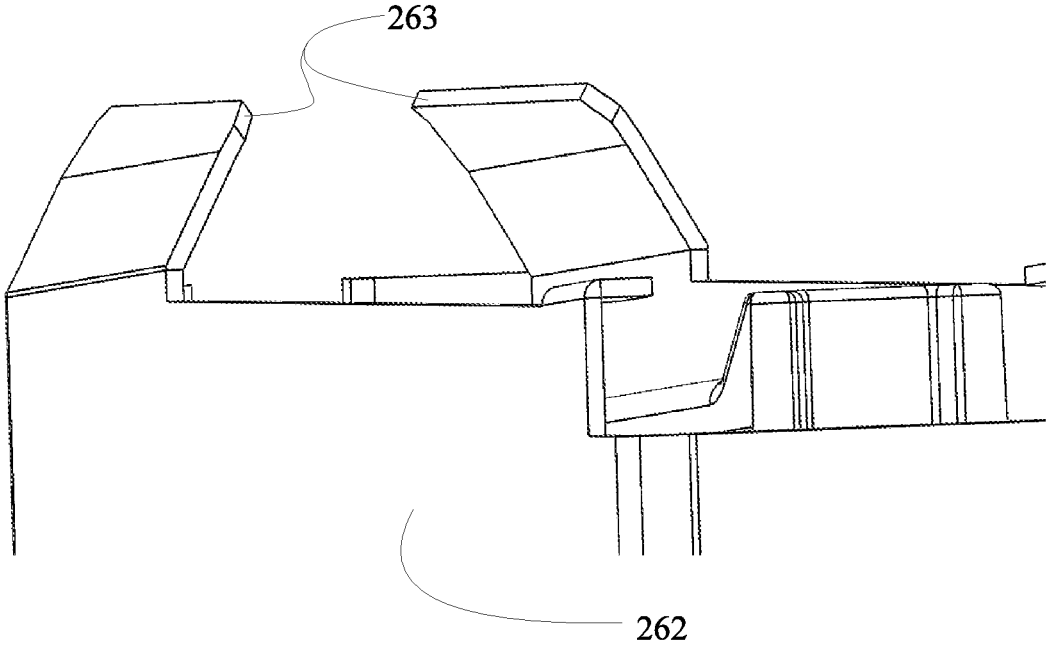
FIG. 11 is a side/oblique view of the top end of the magazine of the present invention, showing the magazine ears and other details.
Figure 12:
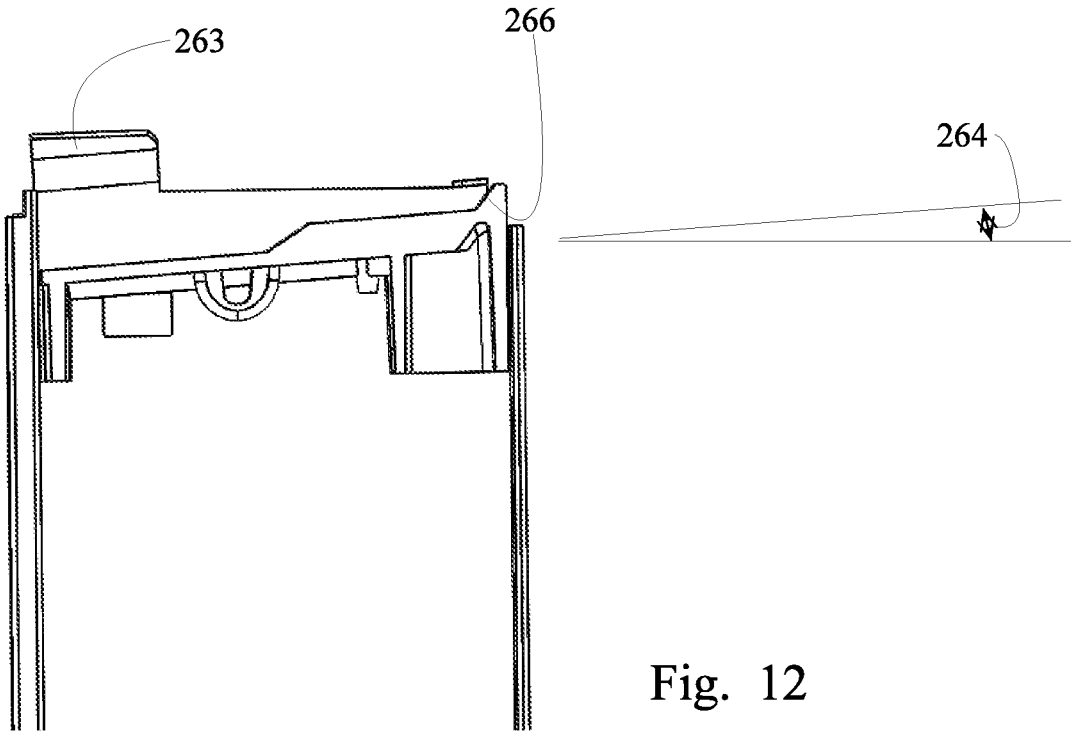

FIG. 11*a* side/oblique view of the top end of the magazine of the present invention, showing the magazine ears and other details and FIG. 12 is a cross-sectional side view of the top end of the magazine of the present invention showing details of the angle of the features of the magazine, the feed lip out of the magazine and so on.

Magazine 262 has magazine ears 263 disposed at the back end of the shells (presently 2.75" shells and 3" shells). The ears 263 firmly hold shells in place.

Figure 13:
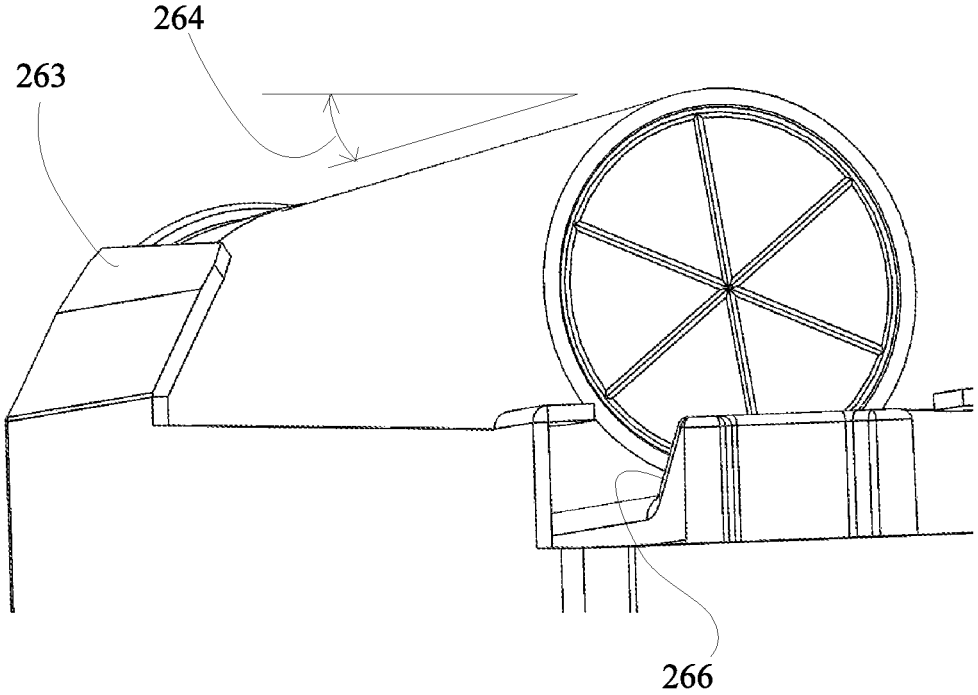

The magazine is designed to hold the shells at a slight angle, magazine shell angle 264 in cooperation with the firm hold provided by ears 263. Magazine feed lip 266 may be seen as well. FIG. 13 is an oblique view of the top end of the magazine of the semi-automatic shotgun of the present invention, with a shell properly secured therein, showing the angle 264 of the shell, the angle of the feed lip 266 and so on. The shell perches on feed lip 266: as it is stripped up by the returning bolt 242, it will naturally be rotated, actually downward for a brief interval of time.

Figure 14:
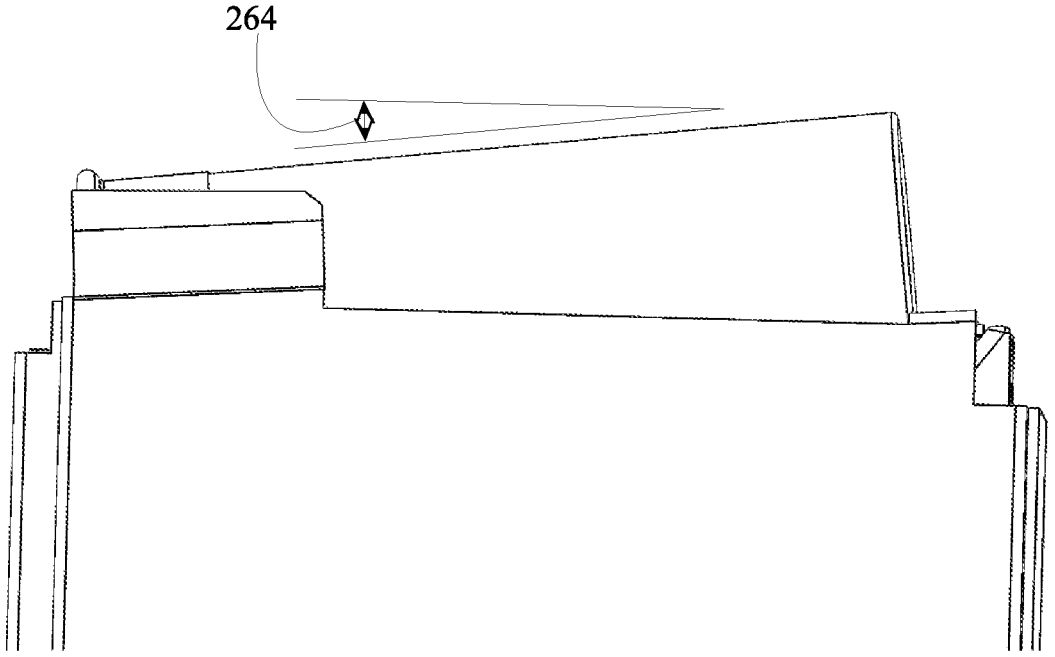
FIG. 14 is a side view of the top end of the magazine of the semi-automatic shotgun of the present invention, with a shell properly secured therein, showing the noticeable angle of the shell.

FIG. 14 is a side view of the top end of the magazine of the semi-automatic shotgun of the present invention, with a shell properly secured therein, showing the noticeable angle 264 of the shell, and the fact that the shell is not perched upon the feed lip 266 when in rest.

Figure 15:
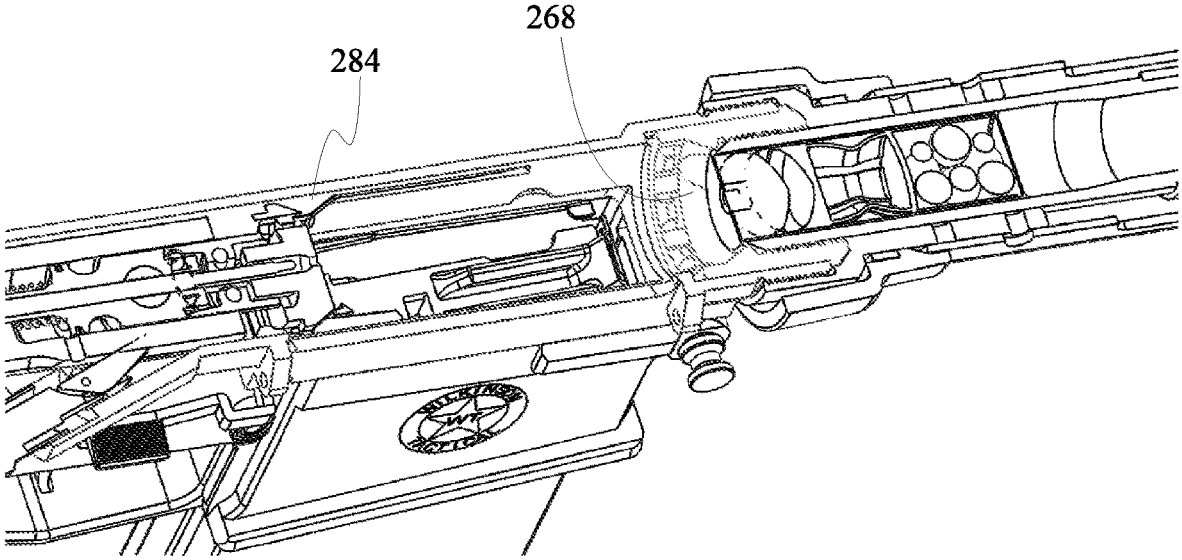
FIG. 15 is an elevational oblique perspective and cross-sectional view of the top of the semi-automatic shotgun of the present invention with a shell chambered, showing in particular the feed ramp from the magazine to the rear end of the barrel assembly.

Feed lip 266 is a very important piece of the shell feed mechanism, and it cooperates with a shell feed ramp 268: FIG. 15 is an elevational oblique perspective and cross-sectional view of the top of the semi-automatic shotgun of the present invention with a shell chambered, showing in particular the feed ramp 268 from the magazine to the rear end of the barrel assembly.

Barrel extension feed ramp 268 obviously accepts the front edge of the shell after feed lip 266 has raised it partially. The combination of the two, lip and ramp, respectively in the magazine and the barrel extension, along with the orientation of the shell with its slight angle 264 (5 degrees, for example) combine to provide a smooth feed of the blunt ended shotgun shell. In addition, the second shell (or magazine follower on the final shell) is pushing upward and also helps position the first shell in the feed ramp.

Figure 16:
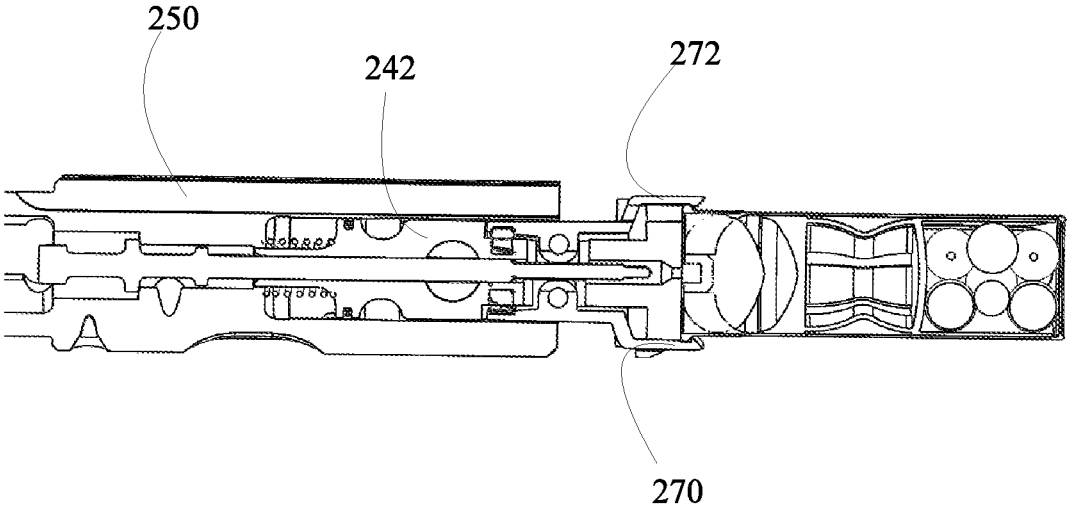
FIG. 16 is a cross-sectional top view of the mechanism of the semi-automatic shotgun of the present invention with a shell depicted, showing details of the extractors within the bolt assembly.
Figure 17:
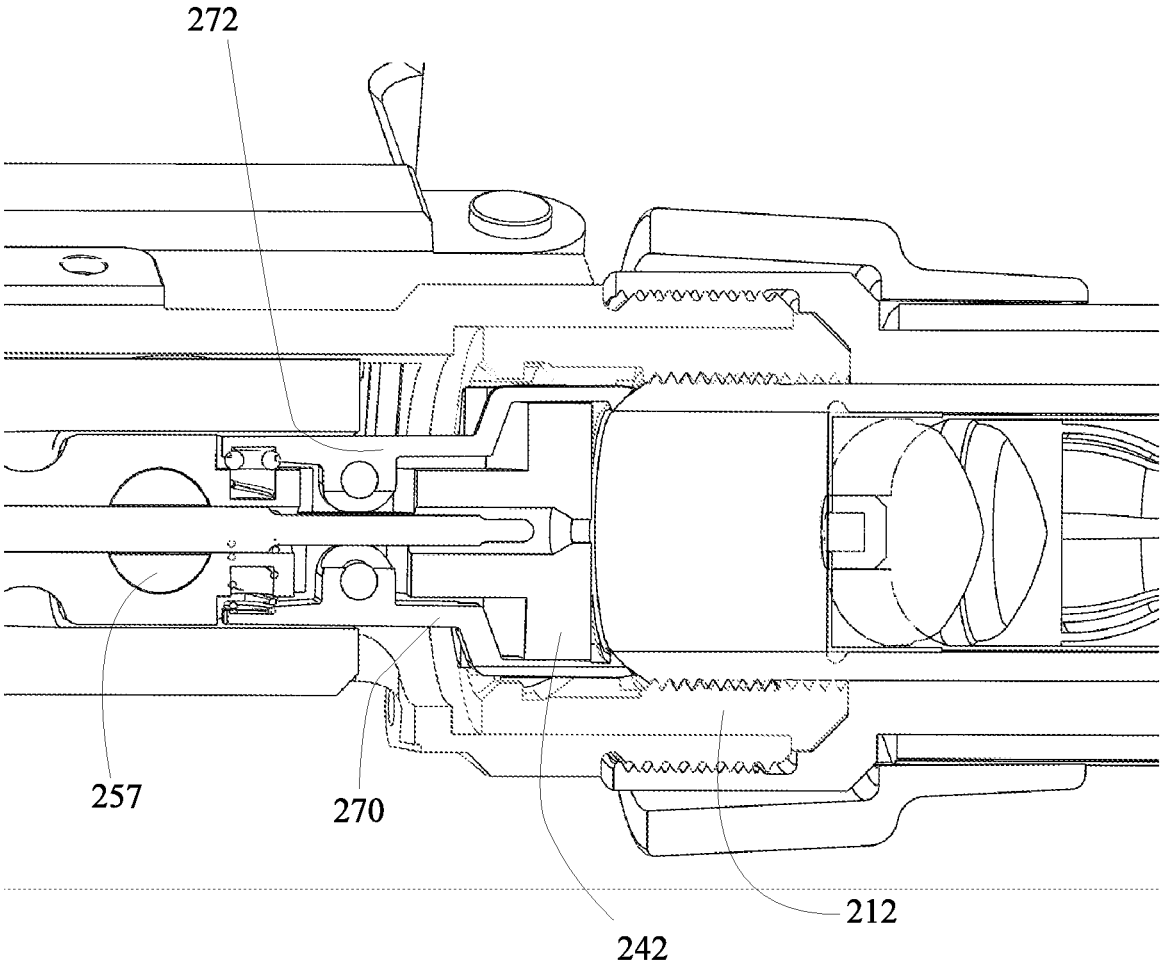
FIG. 17 is a cross-sectional view of the overall extractor system of the semi-automatic shotgun of the present invention.

FIG. 16 is a cross-sectional top view of the mechanism of the semi-automatic shotgun of the present invention with a shell depicted, showing details of the extractors within the bolt assembly, useful to discuss the interaction of the extractors and the shell. FIG. 17 is a cross-sectional view of the overall extractor system of the semi-automatic shotgun of the present invention. Extractors 270 and 272 cooperate to pull the shell husk backward from chamber 206 in a symmetrical orientation: the shell is pulled equally on both sides, which avoids the shell actually jamming on extraction. Bolt 242 and bolt carrier 250 move, the bolt carrier 250 first, then the bolt 242. Note that after the extraction begins, the ejector will in fact later knock the shell husk progressively out of alignment in order to eject it: first freeing it from ejector 272, then a split second later from ejector 270, leaving it flying to the right and out the ejector port 110.

FIG. 17 provides the clearest view of the cam pin passage through bolt 242.

Figure 18:
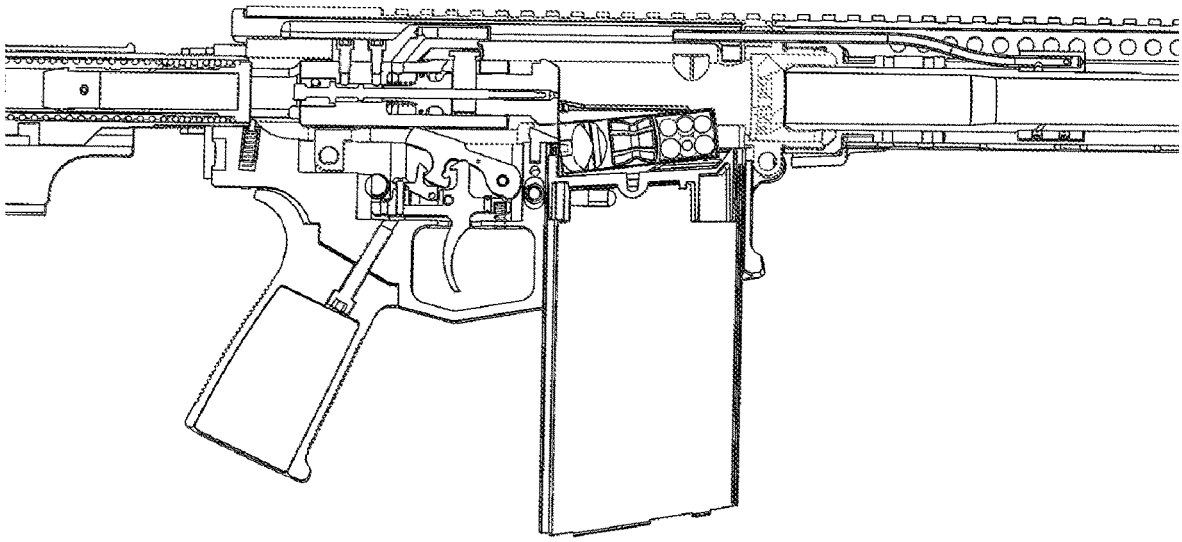
FIG. 18 is a cross-sectional side view of the first step in one complete cycle of mechanism of the present invention, to be viewed as a sequence from FIG. 18 through FIG. 24.

FIG. 18 is a cross-sectional side view of the first step in one complete cycle of mechanism of the present invention, to be viewed as a sequence from FIG. 18 through FIG. 24. The chamber is empty, but the topmost shell is sitting at an angle in the magazine, its rear held down firmly while the blunt front end projects upward just a small amount into the path of the bolt.

Figure 19:
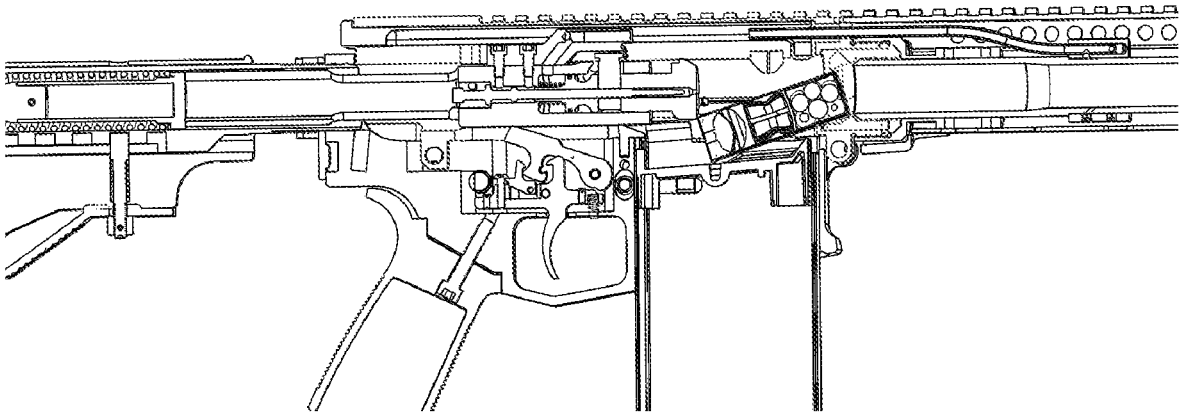
FIG. 19 is a cross-sectional side view of the second step in one complete cycle of mechanism of the present invention.

FIG. 19 is a cross-sectional side view of the second step in one complete cycle of mechanism of the present invention: the bolt is moving forward and has caught the rear end of the shell and started to push the shell forward toward the chamber. Meanwhile the feed lip (magazine) and the feed ramp (barrel extension) have cooperated to feed the blunt front of the shell directly to the chamber.

It is worth noting that a second shell is now moving upward in the magazine, and the front end of that second shell will actually be under the bolt as it moves forward.

Figure 20:
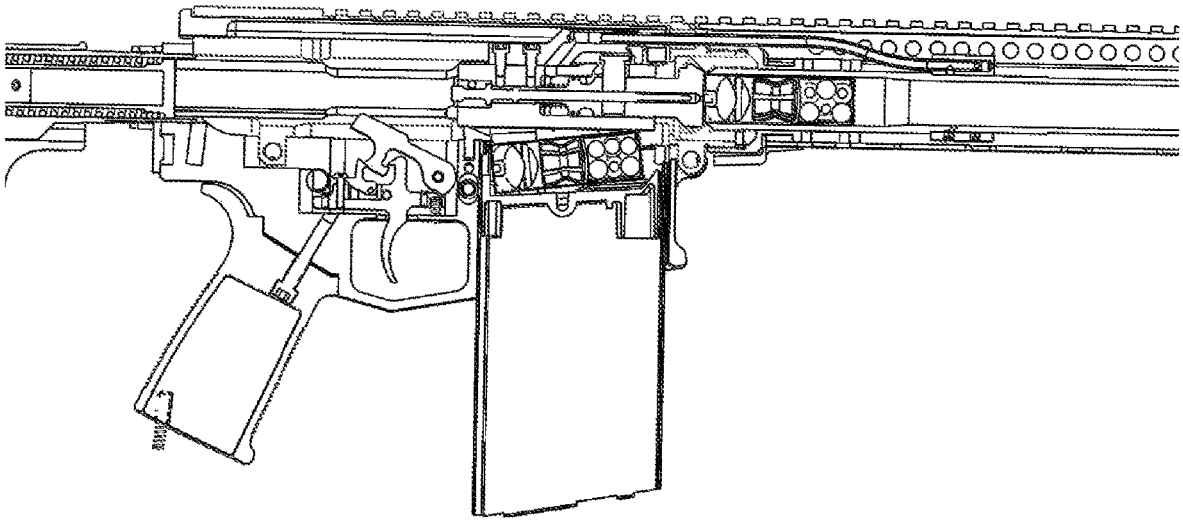
FIG. 20 is a cross-sectional side view of the third step in one complete cycle of mechanism of the present invention.

FIG. 20 is a cross-sectional side view of the third step in one complete cycle of mechanism of the present invention: the shell chambered, the action cocked and the beveled bolt face cooperating with the feed ramp.

Figure 21:
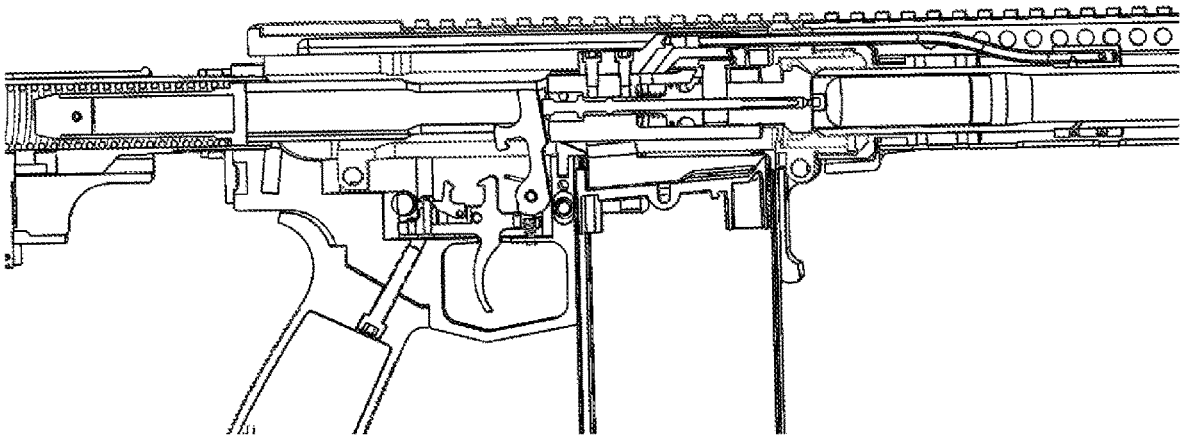
FIG. 21 is a cross-sectional side view of the firing step in one complete cycle of mechanism of the present invention.

FIG. 21 is a cross-sectional side view of the firing step in one complete cycle of mechanism of the present invention. The trigger has been pulled and the hammer has risen from the action up into the space behind the bolt carrier to strike the firing pin, which has penetrated the primer.

Figure 22:
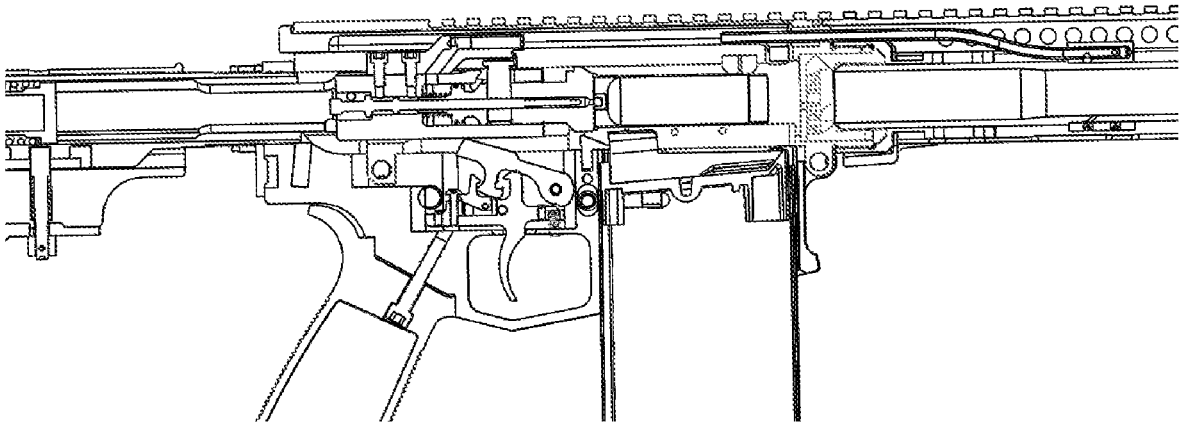
FIG. 22 is a cross-sectional side view of the next step (extraction) in one complete cycle of mechanism of the present invention, which may be compared to FIGS. 16 and 17.

After FIG. 21 and before FIG. 22, gas from the shell will travel from the port back through the gas tube, pushing the BCG backward away from the bolt and expanding the special spring on the bolt tail. However, the camming action of the cam pin will rotate the bolt so that the locking lugs disengage. The much greater pressure within the chamber will then be free to force the bolt itself backward and back into the BCG, compressing the spring, as the spent shell is dragged backward. FIG. 22 is a cross-sectional side view of the next step (extraction) in one complete cycle of mechanism of the present invention, which may be compared to FIGS. 16 and 17: the shell has been extracted and pulled back over the magazine once again, into the region of the ejection port 110. Note that the bolt head could travel backward more easily due to the backside partial bevel of the bolt face.

Figure 23:
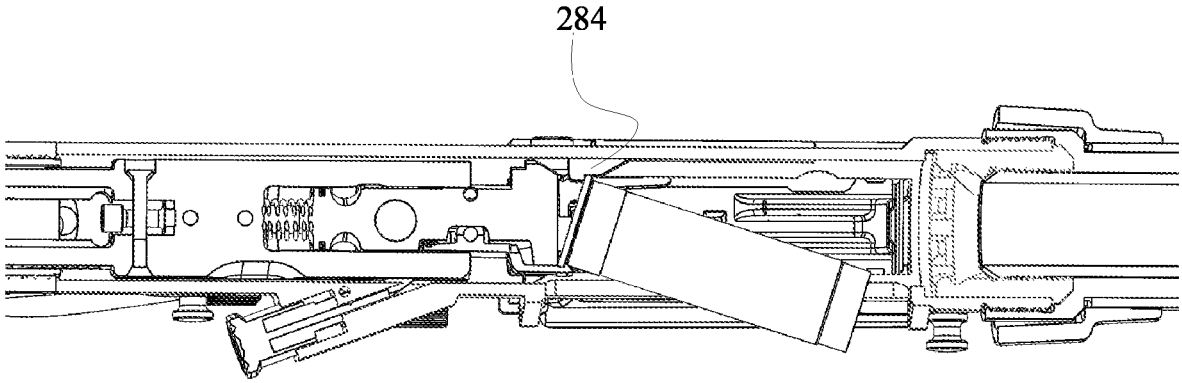
FIG. 23 is a cross-sectional TOP view of an ejection in progress in one complete cycle of mechanism of the present invention.
Figure 24:
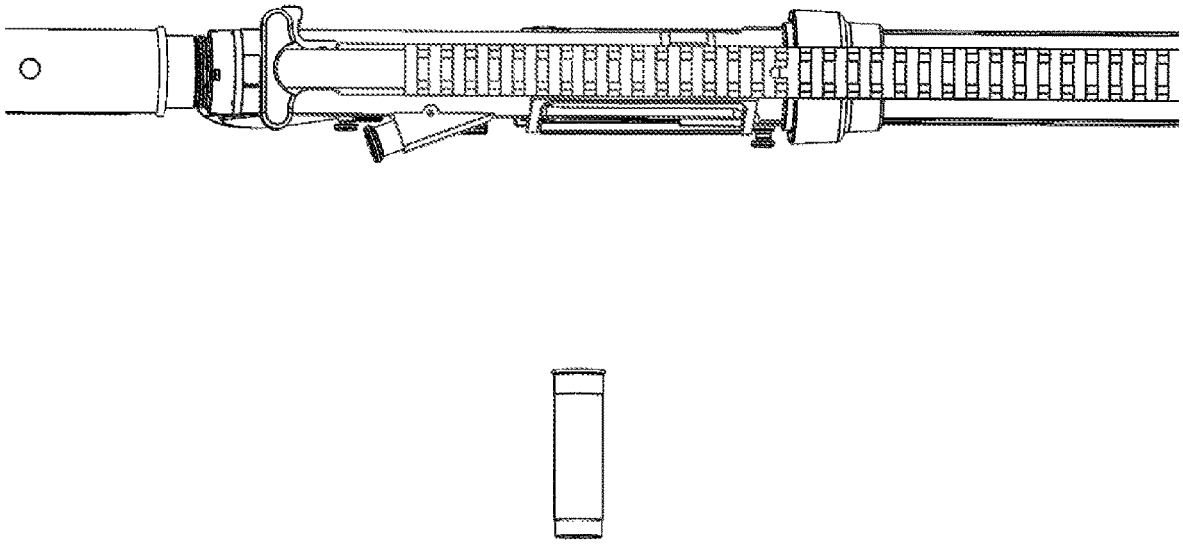
FIG. 24 is a cross-sectional top view of the present invention, showing a shell leaving the area of the semi-automatic shotgun.

FIG. 23 is a cross-sectional TOP view of an ejection in progress in one complete cycle of mechanism of the present invention. Since this a top view, ejector 284 may finally be seen clearly as the ramp on the ejector acts to force the shell to disengage from the backside extractor 272 first, and then torques the shell sideways, forcing it to exit the ejection port: and FIG. 24 is a cross-sectional top view of the present invention, showing a shell leaving the area of the semi-automatic shotgun.

The disclosure is provided to render practicable the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

Methods and components are described herein. However, methods and components similar or equivalent to those described herein can be also used to obtain variations of the present invention. The materials, articles, components, methods, and examples are illustrative only and not intended to be limiting.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art.

Having illustrated and described the principles of the invention in exemplary embodiments, it should be apparent to those skilled in the art that the described examples are illustrative embodiments and can be modified in arrangement and detail without departing from such principles. Techniques from any of the examples can be incorporated into one or more of any of the other examples. It is intended that the specification and examples be considered as exemplary only, with a true scope and spirit of the invention being indicated by the following claims.

What is claimed is:

1. A semiautomatic shotgun for use with first and second shotgun shells having a blunt front end, the semiautomatic shotgun comprising:

a lower receiver from the AR-10 family of firearms;

an upper receiver mounted to the lower receiver;

a barrel dimensioned and configured to receive such shotgun shells into a chamber, the barrel having a distal muzzle end and a proximal end, the proximal end having thereon a fixed barrel extension mounted to the upper receiver;

a bolt slidably mounted and dimensioned and configured to slide in and out of the chamber across an open top end of a magazine in an upper receiver main bore;

a bolt carrier mounted in the upper receiver bore so as to be slidable, the bolt extending into the bolt carrier;

a direct impingement gas system in which gas from such first shotgun shell may cause extraction and ejection of such first shotgun shell and feed of such second shotgun shell;

the direct impingement gas system including at least a gas port having upper and lower ends, the gas port passing through the barrel, the gas port having an angle to the barrel of greater than 90 degrees whereby the gas port lower end is slightly closer to the distal muzzle end while the gas port upper end is slightly closer to the proximal end;

a low profile gas block mounted to the barrel at the gas port upper end;

a gas tube elevated above the barrel, the gas tube connecting at a first end the gas port upper end and at a second end a gas key;

the gas key having an aperture therethrough from the gas tube to a gas impingement chamber;

the gas impingement chamber located within the bolt carrier, a first side of the gas impingement chamber being the bolt;

the bolt slidably mounted within the bolt carrier such that the bolt may move relative to the bolt carrier, whereby the gas impingement chamber may change volume, and further whereby a pressure increase within the gas impingement chamber may cause the bolt and the bolt carrier to move relative to one another;

the bolt having a bolt tail projecting from the first side of the gas impingement chamber;

a spring mounted upon the bolt tail within the gas impingement chamber;

a cam pin passing through the bolt, the cam pin having a first end slidably mounted within an angled slot whereby when the bolt moves backward it is impelled to rotate due to the motion of the cam pin the angled slot;

a plurality of locking lugs on a front end of the bolt, the locking lugs dimensioned and configured to engage to the fixed barrel extension when the bolt is in a first firing position, and configured to rotate and disengage from the fixed barrel extension when the bolt rotates and moves backward into a second position;

whereby when the locking lugs disengage, a gas pressure in the chamber may cause rearward motion of the bolt carrier, and whereby the magazine is mounted to the lower receiver, the magazine having on the top end an angled feed lip adapted to maintain a consistent feed angle as the shotgun shell is fed from the magazine and to hold down slightly a rear portion of the uppermost shotgun shell in the magazine, and to align the uppermost shotgun shell at an angle corresponding to the angle of the angled feed lip, such that when such first and second shotgun shells are pushed forward by the bolt sliding across the upper top end of the magazine, such blunt front ends are elevated upwards by such angled feed lip, and a magazine follower dimensioned and configured to maintain such first and second shotgun shells at a slight angle to the horizontal, with such shotgun shell front ends elevated upward to meet the angled feed lip of the magazine, and further whereby the semiautomatic shotgun comprises an angled feed ramp, whereby such first and second shotgun shells are pushed forward and such shotgun shell blunt ends are elevated upward by the angled feed ramp of the magazine follower, then such shotgun shell blunt ends are elevated further upward by the angled feed ramp; the angled feed ramp extending to the chamber, with the balance of the feed system designed in a full 360 degree cone to ensure no edges exist to catch the blunt end of the shotgun shell and create a failure, whereby such shotgun shell blunt ends are fed from the magazine into the chamber, and wherein, a bolt face is dimensioned and configured to engage such first and second shotgun shells, the bolt face having a front, the bolt face front having an angled bevel, the angle of the bevel matching the angle of the barrel extension feed ramp, whereby the bolt face meets the barrel extension they seal.

2. The semiautomatic shotgun of claim 1, wherein the bolt face further comprises:

a back of the bolt face, the back of the bolt face having a partial bevel, whereby when the bolt moves backward it does not engage such second shotgun shell blunt front end.

3. The semiautomatic shotgun of claim 1, for use with a standard AR-10 family charge handle, wherein the gas key further comprises:

a coupling dimensioned and configured to engage such standard AR-10 family charge handle, whereby such standard AR-10 family charge handle does not bind to the cam pin, in turn whereby the charge handle may be used to manually retract the bolt carrier.

4. The semiautomatic shotgun of claim 3, wherein:

the barrel has a bore, the bore being greater than the bore of such standard AR-10 firearms;

the gas key further comprises an extension, thereby extending the gas key upward above the barrel.

5. The semiautomatic shotgun of claim 1, wherein:

the gas tube further comprises an extension, thereby extending the gas tube upward above the barrel.

6. The semiautomatic shotgun of claim 1, wherein a plurality of components are nickel-boron plated.

7. The semiautomatic shotgun of claim 1, wherein a plurality of components are nitrated.

8. The semiautomatic shotgun of claim 1, wherein a plurality of components are permanently infused with dry film lubricant.

9. The semiautomatic shotgun of claim 1, wherein a plurality of components are treated to improve lubrication without oil.

10. The semiautomatic shotgun of claim 9, wherein the upper receiver main bore is permanently infused with dry film lubricant and the bolt carrier is treated to improve lubrication without oil.

11. The semiautomatic shotgun of claim 1, wherein the bolt carrier further comprises:

a longitudinal slot, and further wherein the semiautomatic shotgun further comprises:

an ejector dimensioned and configured so that motion of the bolt carrier causes the slot to pass over the ejector, the ejector projecting out into the upper receiver bore and into the path of the first shotgun shell, whereby the first shotgun shell is given a torque, forcing the shell sideways.

12. The semiautomatic shotgun of claim 11, wherein the bolt further comprises at least two extractors, each extractor spring-loaded at a first end and having a slight detent at a second end, the detents oriented to physically engage such first shotgun shell, whereby when the bolt recoils, the extractors pull such first shotgun shell into the upper receiver bore until the ejector first disengages the first shotgun shell from a first one of the two extractors and then second gives the first shotgun shell the torque.

* * * * *